US008718494B2

(12) United States Patent
Oda

(10) Patent No.: US 8,718,494 B2
(45) Date of Patent: May 6, 2014

(54) IMAGE FORMING APPARATUS AND CONSUMABLE SUPPLY MANAGEMENT SYSTEM

(75) Inventor: Yasuhiro Oda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 189 days.

(21) Appl. No.: 13/086,146

(22) Filed: Apr. 13, 2011

(65) Prior Publication Data

US 2012/0163839 A1 Jun. 28, 2012

(30) Foreign Application Priority Data

Dec. 28, 2010 (JP) ..... 2010-292633

(51) Int. Cl.
*G03G 15/00* (2006.01)

(52) U.S. Cl.
USPC ..... 399/24; 399/25; 399/26

(58) Field of Classification Search
USPC ..... 399/27, 81
See application file for complete search history.

(56) References Cited

U.S. PATENT DOCUMENTS

| | | | | |
|---|---|---|---|---|
| 5,278,612 | A | 1/1994 | Inui | |
| 6,510,294 | B1 * | 1/2003 | Hakamada | 399/58 |
| 6,937,999 | B1 * | 8/2005 | Haines et al. | 705/26.35 |
| 2009/0297177 | A1 * | 12/2009 | Shimizu | 399/27 |

FOREIGN PATENT DOCUMENTS

| | | | |
|---|---|---|---|
| JP | 5-053488 | A | 3/1993 |
| JP | 05-188674 | A | 7/1993 |
| JP | 05-323841 | A | 12/1993 |
| JP | 2004-045557 | A | 2/2004 |

OTHER PUBLICATIONS

B6200/6300 series Technical Reference Manual, OKI Data, Jan. 31, 2008.*

* cited by examiner

*Primary Examiner* — Clayton E Laballe
*Assistant Examiner* — Victor Verbitsky
(74) *Attorney, Agent, or Firm* — Sughrue Mion, PLLC

(57) ABSTRACT

An image forming apparatus includes an image forming section that forms an image, a plurality of detectors that detect an amount of variation of indicators respectively determining an amount consumed of the consumable supply, a determination section that determines whether or not the amount of variation has reached any one of first lifespan values, an interruption section that interrupts an image forming operation based on the first lifespan values, and an extension setting section that inhibits the interruption of the image forming operation and sets an extension mode of extending a period of execution of the image forming operation, wherein the determination section determines whether or not an amount of variation of one indicator has reached an extended lifespan value when the extension mode is set, and wherein the interruption section interrupts the image forming operation based on extended lifespan value when the extension mode is set.

3 Claims, 13 Drawing Sheets

FIG.8A

| CONSUMPTION LEVEL | DETECTION DATE |
|---|---|
| La1 | 2010.06.16 |
| La2 | 2010.07.25 |
| La3 | — |
| La4 | — |
| La5 | — |

FIG.8B

| CONSUMPTION LEVEL | DETECTION DATE |
|---|---|
| Lb1 | 2010.06.21 |
| Lb2 | 2010.07.30 |
| Lb3 | — |
| Lb4 | — |
| Lb5 | — |

FIG.8C

| CONSUMPTION LEVEL | DETECTION DATE |
|---|---|
| Lc1 | 2010.05.15 |
| Lc2 | 2010.06.26 |
| Lc3 | — |
| Lc4 | — |
| Lc5 | — |

IMAGE FORMING APPARATUS AND CONSUMABLE SUPPLY MANAGEMENT SYSTEM

CROSS-REFERENCE TO RELATED APPLICATION

This application is based on and claims priority under 35 USC 119 from Japanese Patent Application No. 2010-292633 filed on Dec. 28, 2010.

BACKGROUND

1. Technical Field

The present invention relates to an image forming apparatus and a consumable supply management system.

2. Related Art

Image forming apparatuses, such as a printer, a copier, or a facsimile, which form images based on image information include consumable supplies, for example, a photosensitive member, a charging unit, and a developer container. As the amount of these consumable supplies is depleted through use and they reach the end of their lifespan value, they are not able to be used properly or they are not able to function properly, resulting in an adverse effect on image formation.

Therefore, in the image forming apparatuses, the amount consumed of these consumable supplies is detected. When the consumed amount detected reaches predetermined lifespan values, a print operation is interrupted, and an alarm unit informs a user of a fact that replacement or the like of a consumable supply which has reached its lifespan value is needed, for example, by displaying a message.

SUMMARY

The invention provides an image forming apparatus which has a function of allowing a user to select an extension process of extending a period in which a print operation can be executed by inhibiting an interruption process of interrupting the print operation when a consumable supply such as a photosensitive member is determined to have reached a predetermined lifespan, which accurately manages the progress in which the consumable supply reaches the end of its lifespan when the extension process is not selected, which efficiently manages the progress in which the consumable supply reaches the extended lifespan when the extension process is selected, and which can perform the print operation appropriately. The invention also provides a consumable supply management system including the image forming apparatus.

According to an aspect of the invention, there is provided an image forming apparatus including:

an image forming section that includes a consumable supply and forms an image;

a plurality of detectors that detect an amount of variation of each of a plurality of indicators respectively determining an amount consumed of the consumable supply;

a determination section that determines whether or not th amount of variation of each of the respective indicators detected by the plurality of detectors has reached any one of first lifespan values set for the respective indicators;

an interruption section that performs a process of interrupting an image forming operation of the image forming section when the determination section determines that the amount of variation has reached any one of the first lifespan values; and an extension setting section that inhibits the interruption process based on the first lifespan value by the interruption section and sets an extension mode of extending a period in which the image forming operation can be executed, wherein the determination section determines whether or not an amount of variation of one indicator specified out of the plurality of indicators has reached an extended lifespan value different from the first lifespan value set for the specified indicator when the extension mode is set by the extension setting section, and wherein the interruption section interrupts the image forming operation when the extension mode is set by the extension setting section and the determination section determines that the amount of variation has reached the extended lifespan value.

BRIEF DESCRIPTION OF THE DRAWINGS

Exemplary embodiments of the present invention will be described in detail based on the following figures, wherein:

FIGS. 8A to 8C are tables showing detection histories (stored contents) of the respective indicators;

DETAILED DESCRIPTION

<First Exemplary Embodiment>

Figure 1:
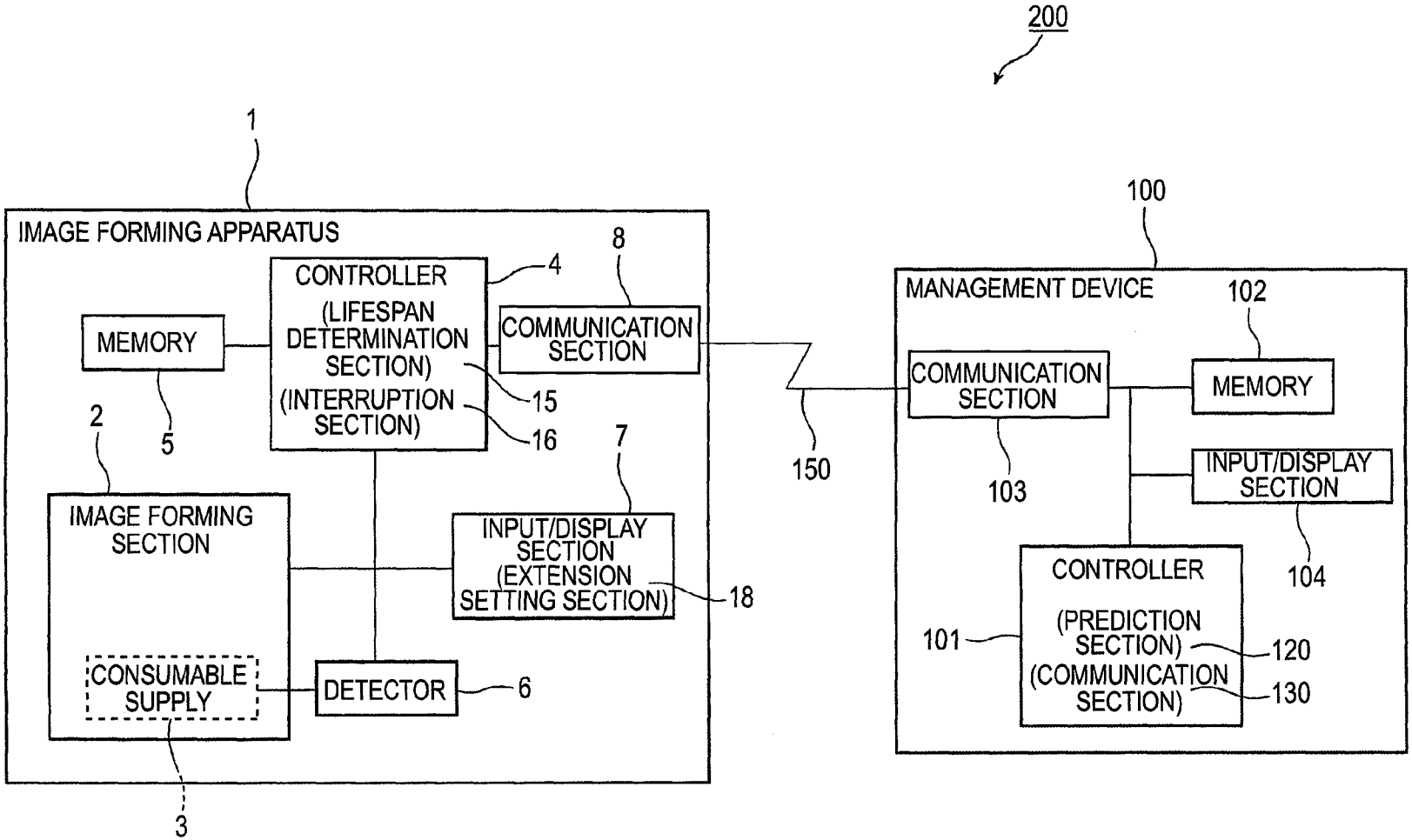
FIG. 1 is a block diagram showing an outline of an image forming apparatus, a memory, and a consumable supply management system according to a first exemplary embodiment.

FIG. 1 shows an outline of a configuration example of an image forming apparatus 1 and a management device 100 according to a first exemplary embodiment of the invention. In this example, the entire system including the image forming apparatus 1 and the management device 100 will be referred to as a consumable supply management system 200.

The image forming apparatus 1 includes an image forming section 2 that has consumable supplies 3 and forms an image, a controller 4 that controls respective operations and the like in the entire image forming apparatus, a memory 5 that stores programs, data, and the like, a detection section 6 that detects states of constituent components of the image forming section 2 and the like, an input/display section 7 that inputs and displays various kinds of information, a communication section 8 that sends and receives information, and the like. The image forming apparatus 1 is configured as a color printer, for example. Moreover, the image forming apparatus 1 is connected to an information terminal such as a personal computer, an image reading device, or a storage medium read/write device through the communication section 8.

The management device 100 includes a controller 101 that controls the operation of the entire device and an operation of managing the consumable supplies 3 in the image forming apparatus 1, a memory 102 that stores programs, data, and the like, a communication section 103 that sends and receives information, an input/display section 104 that inputs and displays various kinds of information, and the like. The management device 100 and the image forming apparatus 1 are communicably connected by a communication unit 150. Moreover, the management device 100 may be a type that it is provided in the image forming apparatus 1 or may be a type that it is provided at a place physically separated from the image forming apparatus 1. The communication unit 150 is configured, for example, using a connection wire, a telephone line, a wireless communication path, and an Internet line through which information signals can be transmitted.

Figure 2:
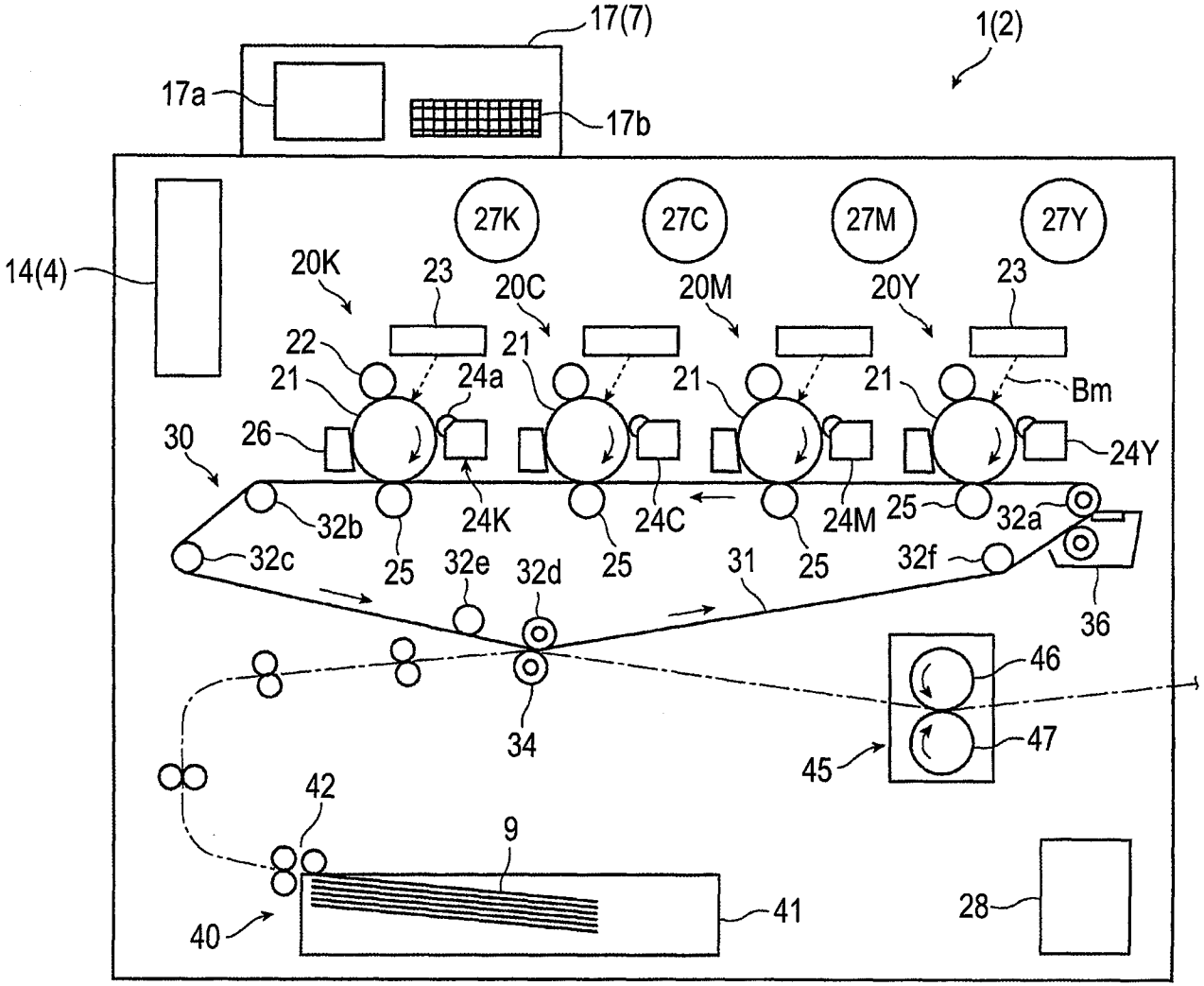
FIG. 2 is a diagram illustrating an outline of the image forming apparatus shown in FIG. 1.

The image forming section 2 of the image forming apparatus 1 has a configuration as shown in FIG. 2, for example. In FIG. 2 and other relevant drawings, reference number 10 is a casing which is an apparatus body, 20Y, 20M, 20C, and 20K are image forming devices that form toner images of four colors of yellow (Y), magenta (M), cyan (C), and black (K), and reference number 30 is an intermediate transfer device that carries the toner images formed by the image forming devices 20 (20Y, 20M, 20C, and 20K) and eventually transfers the toner images to a recording sheet 9 as a recording material. Moreover, reference number 40 is a feeding device that stores the recording sheets 9 of desired sizes, kinds, and the like and feeds the recording sheets to a secondary transfer position in the intermediate transfer device 30, and reference number 45 is a fixing device that passes the recording sheet 9 on which the toner images are transferred so as to fix the toner images. One dot-chain line in FIG. 2 indicates a transport path when the recording sheet 9 is transported in the casing 10.

The respective image forming devices 20Y, 20M, 20C, and 20K include a rotating photosensitive drum 21, and around the photosensitive drum 21, the following respective devices are disposed. The respective devices include a charging device 22 that charges an image carrying surface (a surface portion carrying a toner image) of the photosensitive drum 21 to a necessary potential, an exposure device 23 that irradiates the charged image carrying surface of the photosensitive drum 21 with light based on image information (signal) to form an electrostatic latent image (for each color) having a potential difference, and a developing device 24Y, 24M, 24C, or 24K that develops the electrostatic latent image with a toner of a corresponding color (Y, M, C, or K) to obtain a toner image which is a visible image. The respective devices also include a primary transfer device 25 that transfers the toner image to the intermediate transfer device 30 (an intermediate transfer belt thereof), and a drum cleaning device 26 that scrapes and removes an adhering material such as the toner which remains and adheres on the image carrying surface of the photosensitive drum 21 after the transferring.

The photosensitive drum 21 is one in which the image carrying surface having a photosensitive film (photoconductive layer) formed of a photosensitive material is formed on a circumferential surface of a grounded cylindrical or columnar base material, and which rotates in a direction indicated by an arrow by receiving power from a rotation driving device (not shown). The charging device 22 is a contact-type charging device in which a charging bias is applied to a charging member such as a charging roller that is disposed in a state of not making contact with the image carrying surface of the photosensitive drum 21.

The exposure device 23 is configured to irradiate the charged image carrying surface of the photosensitive drum 21 with light Bm formed in accordance with the image information input to the image forming apparatus 1 to form an electrostatic latent image. As the exposure device 23, a scanning-type exposure device which is formed using a semiconductor laser and an optical component such as a polygon mirror and a non-scanning-type exposure device which is formed using a light emitting diode, an optical component, and the like are used.

The developing devices 24Y, 24M, 24C, and 24K include a developer container that stores developer (for example, bi-component developer including non-magnetic toner and magnetic carrier), a developing roller 24*a* that rotates and carries the developer stored in the developer container so as to convey the developer to a developing region where it approaches and faces the photosensitive drum 21, an agitation and conveying member that agitates and conveys the developer, and the like. Moreover, in the developing devices 24, a developing bias is applied between the developing roller 24*a*and the photosensitive drum 21, and the developing roller 24*a*and the agitation and conveying member are rotated in a necessary direction. The developing devices 24Y, 24M, 24C, and 24K are refilled with refilling developer which is delivered through a refilling device (not shown) from developer containers 27Y, 27M, 27C, and 27K that store the refilling developer (toner only or toner including carrier) of the four colors (Y, M, C, and K).

The primary transfer device 25 is a contact-type transfer device that rotates in contact with the image carrying surface of the photosensitive drum 21 with an intermediate transfer belt 31 described later disposed therebetween and includes a primary transfer roller to which a primary transfer bias is applied. The drum cleaning device 26 includes, for example, a cleaning blade that is disposed so as to make contact with the image carrying surface of the photosensitive drum 21 at a necessary angle and a cleaning rotary brush that is disposed so as to rotate in contact with the image carrying surface of the photosensitive drum 21. A belt cleaning device 36 described later has substantially the same configuration as the drum cleaning device 26.

The intermediate transfer device 30 is disposed so as to be below the respective image forming devices 20Y, 20M, 20C, and 20K which are in the state of being arranged in series. The intermediate transfer device 30 includes the intermediate transfer belt 31 that rotates in a direction indicated by an arrow while passing through a primary transfer position which is between the photosensitive drum 21 and the primary transfer device 25 (primary transfer roller), plural supporting rollers 32*a* to 32*f* that rotatably support the intermediate transfer belt 31 from an inner surface thereof so as to maintain a desired state, a secondary transfer roller 34 that rotates in contact with the intermediate transfer belt 31 being supported by the supporting roller 32*d* with predetermined pressure, and the belt cleaning device 36 that removes toner or the like which remains and adheres on the intermediate transfer belt 31 after having passed through the secondary transfer roller 34. A secondary transfer bias is supplied to the supporting roller 32*d* or the secondary transfer roller 34.

The feeding device 40 is attached to a front surface (a side surface which the user faces during operation) of the casing 10 so as to be drawn out. The feeding device 40 includes one or plural sheet containers 41 that store the recording sheets 9 of desired sizes, kinds, and the like in a stacked state and a delivery device 42 that delivers the recording sheets 9 from the sheet container 41 one by one. The recording sheet 9 delivered from the feeding device 40 is transported to a secondary transfer position through a supply transport path which is formed by plural transport roller pairs and a transport guide member.

The fixing device 45 includes a heating rotating member 46 and a pressurizing rotating member 47 which are provided within the casing. The heating rotating member 46 rotates in a direction indicated by an arrow and is heated by a heater so that a surface temperature is maintained at a predetermined temperature. The pressurizing rotating member 47 is rotated while making contact with the heating rotating member 46 with predetermined pressure in a state of extending substantially in an axial direction of the heating rotating member 46. The recording sheet 9 in which toner images are fixed by the fixing device 45 and an image is formed thereon is transported and stored in a discharge section provided in the casing 10 and the like through a discharge transport path which is formed by plural transport roller pairs and a transport guide member.

A basic print operation by the image forming apparatus 1 (the image forming section 2) is performed as described below. In this example, a pattern (full-color mode) of a print operation of forming a full-color image formed by combining toner images of the four colors (Y, M, C, and K) formed using all of the four image forming devices 20Y, 20M, 20C, and 20K will be described.

When a request (print request) for a print operation is issued by the information terminal or the like, first, the respective photosensitive drums 21 of the four image forming devices 20Y, 20M, 20C, and 20K rotate in the direction indicated by the arrow, and the respective charging devices 22 charge the image carrying surfaces of the respective photosensitive drums 21 to a necessary polarity (negative polarity in the first exemplary embodiment) and potential. Subsequently, the exposure devices 23 perform exposure by irradiating the charged image carrying surfaces of the photosensitive drums 21 with light emitted based on image data decomposed into respective color components (Y, M, C, and K) transmitted from an image processing apparatus (not shown) to thereby form electrostatic latent images of the respective color components which have necessary potential differences. Subsequently, the respective developing devices 24Y, 24M, 24C, and 24K supply toner of the corresponding colors (Y, M, C, and K) charged to necessary polarities (negative polarities) to the electrostatic latent images of the respective color components formed on the photosensitive drums 21 so as to electrostatically adhere thereon. In this way, the electrostatic latent images of the respective color components formed by the photosensitive drums 21 are developed with the toner of the corresponding colors so as to appear as toner images of the four colors.

Subsequently, the toner images of the respective colors formed on the photosensitive drums 21 of the respective image forming devices 20Y, 20M, 20C, and 20K are primarily transferred by the primary transfer device 25 in a way such that they are sequentially superimposed on the intermediate transfer belt 31 of the intermediate transfer device 30. Subsequently, the intermediate transfer device 30 carries and conveys the toner images primarily transferred to the intermediate transfer belt 31 to a secondary transfer position, and then, the secondary transfer roller 34 secondarily transfers the toner images to the sheet 9 which is transported and supplied from the feeding device 40 in a collective manner. The sheet 9 in which the toner images are secondarily transferred is separated from the intermediate transfer belt 31 and guided into the fixing device 45 in which the sheet 9 is subjected to a necessary fixing process (heating and pressurization), whereby the toner images are fixed thereon. When printing is performed on only one side of a sheet, the sheet 9 which has been subjected to the fixing is discharged and stored in a discharge container (not shown) formed in the casing 10, for example. Through the operations above, the sheet 9 in which the full-color image formed by combining the toner images of the four colors is formed is output.

In FIG. 2, reference number 14 is a control device which corresponds to the controller 4, and reference number 17 is an operation panel as a user interface (UI) which corresponds to the input/display section 7. The operation panel 17 includes a display device 17*a* that is formed of a liquid crystal display or the like, an input device 17*b* that includes a number pad, a select button, and a touch panel, and the like. In FIG. 2, reference number 28 is a collection container for storing the adhering material such as toner removed and collected by the drum cleaning device 26 and the belt cleaning device 36 and the developer partially discharged from the developing device 24 by conveying the adhering material and the developer through a collection conveyance path (not shown).

The control device 14 (the controller 4) includes an arithmetic processing device, a storage element and device, a control device, an input/output device, and the like and is configured to execute a necessary control operation based on control program and data stored in the storage element (ROM or the like) thereof. The memory 5 shown in FIG. 1 is formed of the storage element and device (a ROM, a RAM, a magnetic disk device, or the like) of the control device 14. The control device 14 is connected to the image forming section 2, the memory 5, the input/display section 7, the communication section 8, and the like which are control targets to thereby be able to transmit a control signal necessary for the control operation. Moreover, the control device 14 is also connected to the detection section 6 that detects the respective states of the image forming apparatus to thereby be able to receive control information necessary for the control operation.

<Configuration Relating to Lifespan Management or the like of Consumable Supplies>

The control device 14 of the image forming apparatus 1 is configured to function as a lifespan determination section 15 that performs a process of determining the lifespan of the photosensitive drum 21 or the like which is an example of the consumable supply 3 of the image forming section 2 and an interruption section 16 that performs a process of interrupting the print operation by the image forming section 2 when the consumable supply 3 reaches the end of its lifespan. The lifespan determination process and the process of interrupting the print operation are executed as one of the control operations by the control device 14.

Moreover, the operation panel 17 of the image forming apparatus 1 is configured to function as an extension setting section 18 that selects and sets a process (extension mode) of extending a period in which the print operation of the image forming section 2 can be executed by inhibiting the interruption process of the interruption section 16, which is executed when the lifespan determination section 15 determines that the lifespan has ended. The selection and setting of the extension mode by the extension setting section 18 can be performed by operating the input device 17*b* and the like in accordance with a setting screen displayed on the display device 17*a* of the operation panel 17. Moreover, the setting of the extension mode by the extension setting section 18 may be performed from the information terminal that is connected to the image forming apparatus 1.

The detection section 6 includes various kinds of sensors, counters, measuring instruments, and the like. Detection of information on the photosensitive drum 21 as the consumable supply 3 is performed using three indicators A, B, and C for determining the amount consumed of the photosensitive drum 21. The indicator A indicates the thickness of the photosensitive film of the photosensitive drum 21 and is detected by a detector 61 that performs charge quantity measurement described below. The indicator B indicates the number of pages printed (the number of processed recording sheets 9 on which images are formed) and is detected by accumulating the number of processed pages included in print information managed by the control device 14 using an accumulation counter. The indicator C indicates the number of rotations of the photosensitive drum 21 and is detected by a rotation meter 65 described later.

Figure 3:
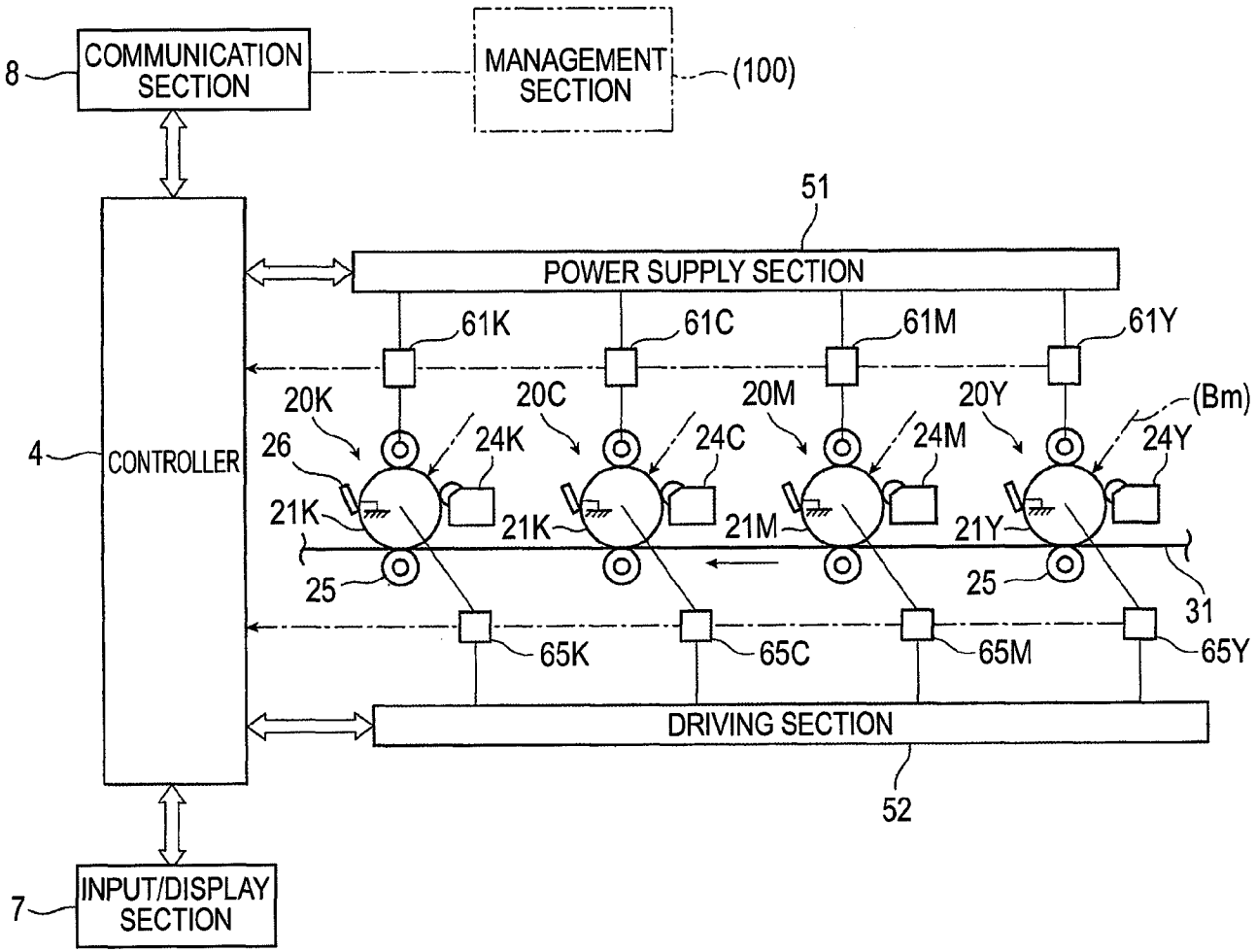
FIG. 3 is a diagram illustrating a part of a detection section of the image forming apparatus shown in FIG. 1.

The detectors 61Y, 61M, 61C, and 61K detect the thickness of the photosensitive film of the photosensitive drum 21, which is the indicator A, in the following manner. For example, as shown in FIG. 3, the detectors 61Y, 61M, 61C, and 61K measure values of current passing from the respective charging devices 22 to the photosensitive drums 21 when the photosensitive drums 21Y, 21M, 21C, and 21K are charged by the respective charging devices 22 during the print operation or the like, calculate charge quantities on the image carrying surfaces of the photosensitive drums 21 based on the current values, and calculate the thicknesses of the photosensitive films from the charge quantities. A charging bias (a DC voltage or a voltage in which a DC voltage and an AC voltage are superimposed) is applied from a power supply 51 to the respective charging devices 22. Although the thickness is calculated on the control device 14 side, it may be calculated by the detector 61. The detection information and the like obtained by the respective detectors 61Y, 61M, 61C, and 61K are individually transmitted to the control device 14.

More specifically, the detection of the thickness through the charge quantity measurement is performed as follows. A charge detection section detects the charge quantity by integrating the measured current value over a period until a surface voltage of the photosensitive drum 21 is substantially identical to a voltage applied by the charging device 22 (a charging member such as a charging roller), and a thickness d is calculated based on Equation 1 below from the calculated charge quantity.

$$d = \in \cdot (\text{Effective Charging Length}) \cdot (\text{Photosensitive Drum Diameter}) \cdot \pi \cdot V/Q \quad \text{(Equation 1)}$$

In Equation 1 above, $\in$ is a dielectric constant of the photosensitive member, V is an applied voltage, and Q is charge quantity.

Moreover, the rotation meters 65Y, 65M, 65C, and 65K detect the number of rotations of the photosensitive drum 21, which is the indicator C, in the following manner. For example, as shown in FIG. 3, the rotation meters 65Y, 65M, 65C, and 65K detect the number of rotations of a detector of an encoder plate attached to a rotation shaft of each of the photosensitive drums 21Y, 21M, 21C, and 21K using a sensor and measure the accumulated number of rotations. The respective photosensitive drums 21 rotate by receiving a rotation power from a rotation driving device 52 which includes a motor, a rotation transfer mechanism, and the like. Although the accumulated number of rotations is measured on the control device 14 side, it may be measured by the respective meters 65Y, 65M, 65C, and 65K. Detection information and the like obtained by the respective meters 65Y, 65M, 65C, and 65K are transmitted individually to the control device 14. When the four photosensitive drums 21Y, 21M, 21C, and 21K have the same size and rotate under the same conditions, only one rotation meter 65 may be provided to only one photosensitive drum 21. Moreover, the rotation meter 65 that detects the number of rotations of the photosensitive drum 21 may be configured to calculate and detect the number of rotations from the rotation speed and the rotation driving of the photosensitive drum 21.

On the other hand, the controller 101 of the management device 100 includes an arithmetic processing device, a storage element and device, a control device, an input/output device, and the like substantially similarly to the control device 14 of the image forming apparatus 1, and is configured to execute a necessary control operation based on control program and data stored in the storage element (ROM or the like) thereof. The controller 101 is connected to the memory 102, the communication section 103, the input/display section 104, and the like which are control targets to thereby be able to transmit a control signal necessary for the control operation. The memory 102 of the management device 100 is formed of the storage element and device (a ROM, a RAM, a magnetic disk device, or the like) of the controller 101. In the memory 102, information which needs to be preserved out of the information transmitted from the image forming apparatus 1 is stored.

The controller 101 is configured to function as a prediction section 120 that performs a process of predicting a date when the consumable supply 3 of the image forming section 2 reaches the end of its lifespan and a notification section 130 that performs a process of notifying the image forming apparatus 1 or the like of the date predicted by the prediction section 120. The process of predicting the end-of-lifespan date and the process of notifying the predicted date are executed as one of the control operations by the controller 101. The input/display section 104 includes a display device that is formed of a liquid crystal display or the like, an input device that includes a number pad, a select button, and a touch panel, and the like similarly to the operation panel 17 of the image forming apparatus 1. When the management device 100 is a type that it is provided in the image forming apparatus 1, the input/display section 104 may be configured to be used as the operation panel 17 (the input/display section 18) of the image forming apparatus 1.

<Lifespan Management Operation>

Operations relating to management of the lifespan of the consumable supply 3 (the photosensitive drum 21) of the image forming apparatus 1 are performed as follows.

Figure 4:
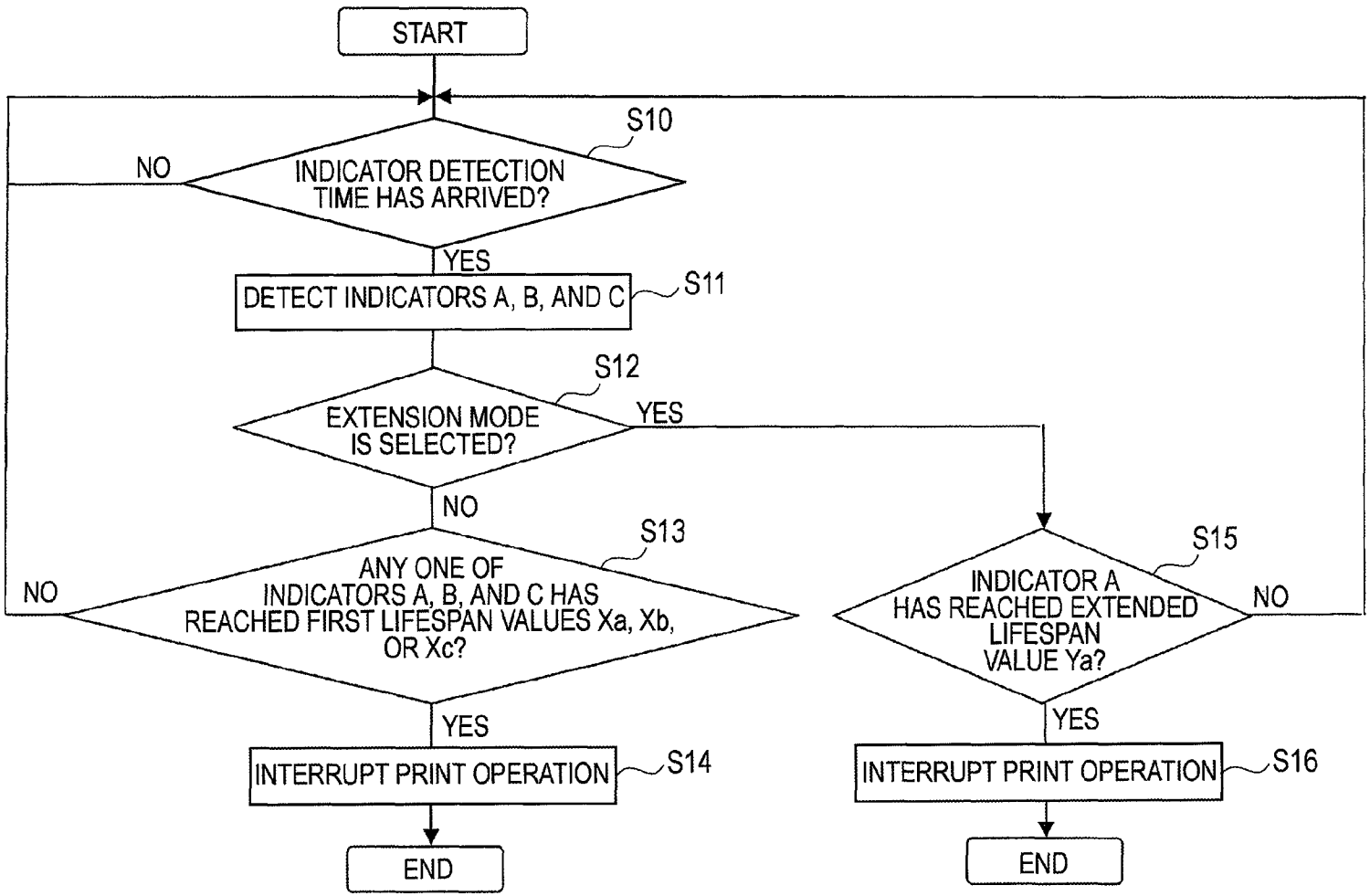
FIG. 4 is a flowchart showing a consumable supply management operation in the image forming apparatus.

That is, as shown in FIG. 4, the control device 14 detects whether the time to detect the indicators A, B, and C has come (S10). When the detection time has arrived, the control device 14 detects the indicators A, B, and C of the photosensitive drum 21 of each of the respective image forming devices 20Y, 20M, 20C, and 20K (S11).

The detection time is set in advance, and for example, is the time at which a predetermined period has elapsed after the start of a print operation, the time at which the number of pages printed has reached a predetermined number, and a predetermined period during the print operation or the like. The detection includes a case where information which has already been detected is read as well as a case where a detecting operation is executed. The thickness of the photosensitive film of the photosensitive drum 21, which is the indicator A, is detected when the detecting and calculating operation by the detector 61 and the like is executed. The number of pages printed which is the indicator B and the number of rotations of the photosensitive drum 21, which is the indicator C, are detected when the information which is measured and stored in the control device 14 (the memory 5) is read. In this detection, results (amounts) of changes in the respective indicators A, B, and C are obtained.

Subsequently, it is determined whether or not the setting for an extension process (extension mode) is selected in the extension setting section 18 (S12). The extension mode selection setting can be arbitrarily made by the user reading a setting screen from the operation panel 17 or the like and performing an input operation. Moreover, the extension mode selection setting may be made by the user performing an input operation as necessary on a setting screen which is automatically displayed on the display section 7 of the operation panel 17 or the like as will be described later.

When it is determined instep S12 that the extension mode is not selected, the control device 14 (the lifespan determination section 15) determines whether or not any one of the indicators A, B, and C has reached predetermined first lifespan values Xa, Xb, and Xc (S13).

Figure 5:
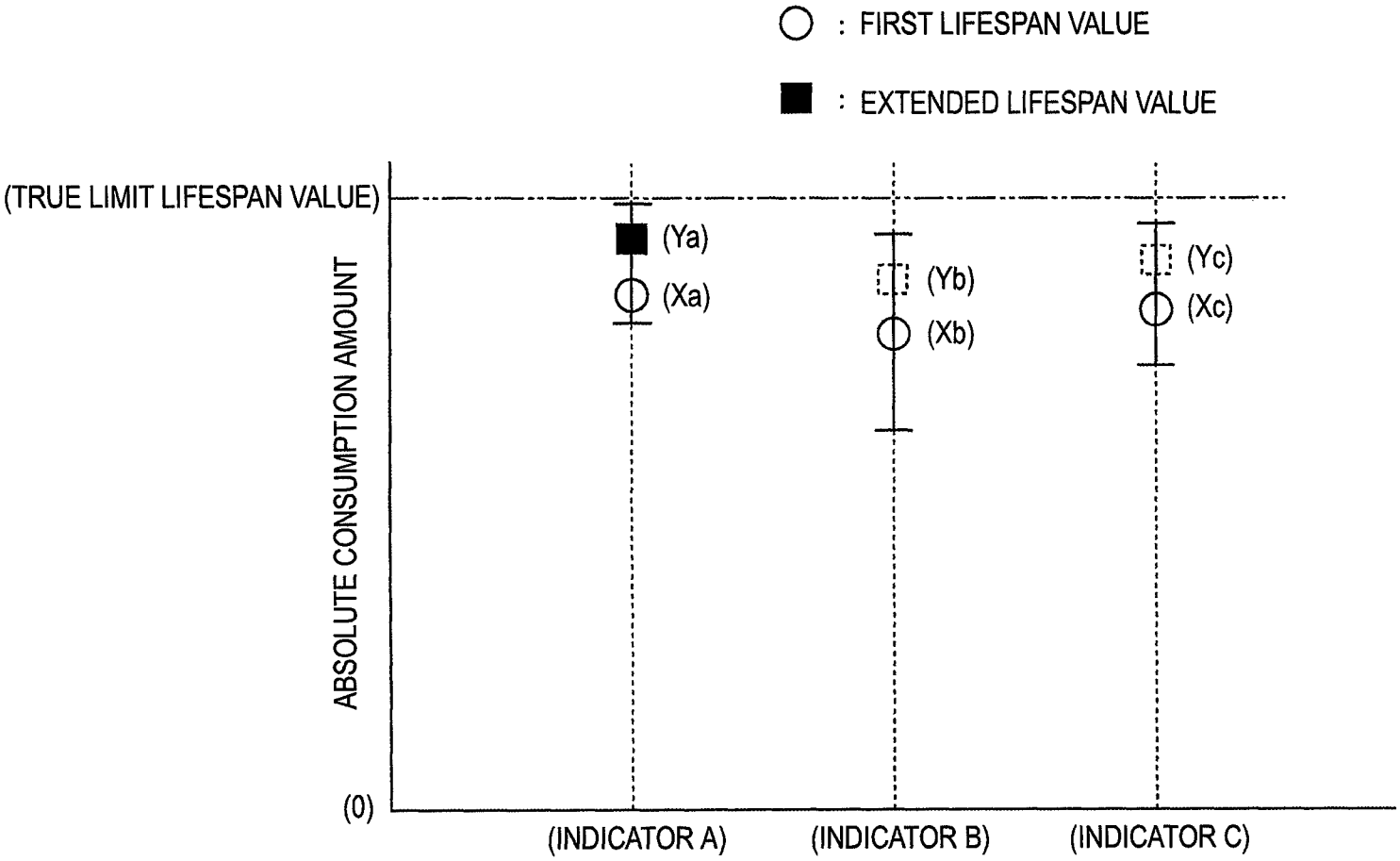
FIG. 5 is a diagram illustrating a relationship of first lifespan values (and extended lifespan values) set for respective indicators.

The first lifespan values Xa, Xb, and Xc are values which are set as a limit lifespan so as not to cause image defects, and for example, are set appropriately in accordance with determination factors of the respective indicators A, B, and C as shown in FIG. 5. In FIG. 5, a vertical axis represents an absolute (true) amount consumed regarding the thickness of the photosensitive film of the photosensitive drum 21. Therefore, the first lifespan values Xa, Xb, and Xc are set to values which are sufficiently smaller than values expected as the true limit lifespan values with respect to any of the respective indicators A, B, and C.

Ranges indicated by bold lines in FIG. 5 suggest that the lifespan values Xa, Xb, and Xc of the respective indicators A, B, and C are likely to vary due to causes such as temperature or humidity. Out of these, since the indicator A indicates the thickness of the photosensitive film, it can be said to be an indicator that can most directly determine a state (amount consumed) of the photosensitive film. Thus, in FIG. 5, the indicator A is illustrated as an indicator of which the range of variation is narrow and which most reliably corresponds to the absolute amount consumed. On the other hand, since the indicators B and C indicate the number of pages printed and the number of rotations of the photosensitive drum, they can be said to be indicators that can determine indirectly the state of the photosensitive film. Moreover, as shown in FIG. 5, the indicators B and C are illustrated as indicators of which the range of variation is wider than the indicator A and which do not match well with the true limit lifespan value.

When it is determined that any one of the indicators A, B, and C has reached the first lifespan value Xa, Xb, or Xc, a process of interrupting the print operation of the image forming section 2 is performed by the processing (control operation) of the control device 14 (the interruption section 16) (S14). In this case, the control device 14 issues an alarm so as to prompt the user to replace the consumable supply 3 by displaying a warning message such as "Please replace the photosensitive drum 21" on the display section 18 of the operation panel 17, for example.

When the interruption process is executed, the user will be unable to perform printing until the user replaces a photosensitive drum or the like of the image forming device 20 having the photosensitive drum 21 which has reached the first lifespan value. In this way, although the photosensitive drum 21 is consumed in accordance with the use thereof, it is possible to obviate problems such as deterioration of image quality resulting from charging defects or the like caused by the consumption. Moreover, in this lifespan management operation, since the amount consumed of the photosensitive drum 21 which is the consumable supply 3 is detected from plural perspectives using the plural indicators A, B, and C, the detection of the amount consumed of the consumable supply 3 and the interruption process based on the first lifespan value X are performed with high accuracy. When it is determined that none of the indicators A, B, and C have reached the first lifespan value, standby is performed until the next indicator detection time comes, and the same operations of the respective steps are repeated.

On the other hand, when it is determined in step S12 that the extension mode is selected, the control device 14 (the lifespan determination section 15) determines whether or not the indicator A has reached a predetermined extended lifespan value Ya (S15). In this determination, since it is only necessary to compare the amount of variation of one indicator A specified out of three indicators A, B, and C with the extended lifespan value Ya, the determination can be performed more efficiently than the determination process of step S13.

Here, the extended lifespan value Ya is a value which is set as a limit lifespan so as not to cause a problem on the image forming apparatus body side but allow minor image defects. Specifically, for example, as shown in FIG. 5, the extended lifespan value Ya is set to a lifespan value which is different from the first lifespan value Xa of the indicator A and which has a large value (amount consumed) so that the time when the photosensitive drum 21 is determined to have reached the end of its lifespan occurs relatively later than that of the first lifespan value Xa. Moreover, as shown in FIG. 5, although the extended lifespan value Ya maybe set to a value that is expected to be near the true limit lifespan value, it is set to a value that is smaller than the true limit lifespan value by a predetermined amount so as to have a margin from the perspective of securely preventing the photosensitive drum 21 from being used over a period exceeding the true limit lifespan value.

At this time, when it is determined that the indicator A has reached the extended lifespan value Ya, a process of interrupting the print operation of the image forming section 2 is performed by the processing of the control device 14 (the interruption section 16) (S16). In this case, the control device 14 also issues an alarm so as to prompt the user to replace the consumable supply 3 as described above.

When the interruption process is executed, the user will be unable to perform printing until the user replaces a photosensitive drum or the like of the image forming device 20 having the photosensitive drum 21 which has reached the extended lifespan value Ya. However, when the extension mode is selected, the user can execute printing for an extended period corresponding to a period between the first time when it has reached one of the first lifespan values X and the time when it has reached the extended lifespan value Y as compared to a case where the interruption process based on the first lifespan value X by the interruption section 16 is inhibited. That is, when it is determined in step S15 that it has not reached the extended lifespan value Ya, standby is performed until the next indicator detection time comes, and the same operations of the respective steps are repeated. Therefore, a period in which a print operation can be executed is extended by an amount corresponding to the period in which the operations are repeated.

<Notification and Display Operation>

In the image forming apparatus 1, the following notification and display operations are performed in relation to the lifespan management operation of the consumable supply 3.

That is, the control device 14 determines whether or not the indicator detection time has come (S30), detects the indicators A, B, and C (S31), and determines whether or not the extension mode is selected (S32) similarly to part (steps S10 to S12 in FIG. 4) of the lifespan management operation. At this time, when it is determined that the extension mode is not selected, it is determined whether or not the amount of variation of each of the respective indicators A, B, and C exceeds one level of each of predetermined consumption levels La, Lb, and Lc (S33, S34, and S35).

Figure 7A:
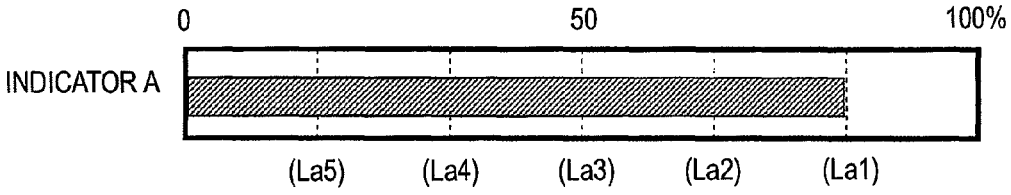
FIGS. 7A to 7C are diagrams illustrating display examples of states of consumption levels of the respective indicators.
Figure 7B:
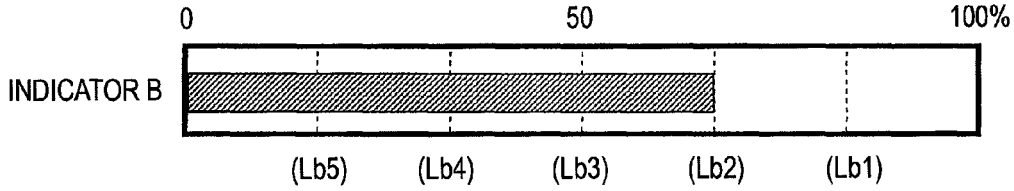
Figure 7C:
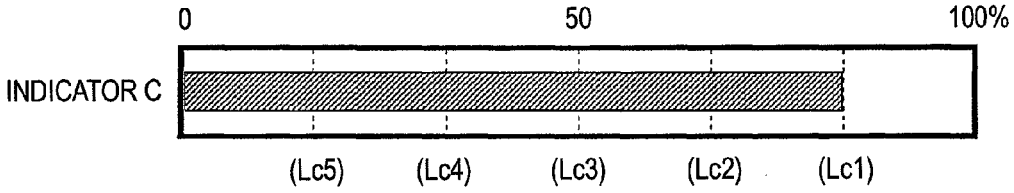

The consumption levels La, Lb, and Lc are attainment levels in which an attainment level of the amounts of variation of the respective indicators A, B, and C from an initial use stage (including the initial use stage after replacement) of the consumable supply 3 to a stage when the amounts of variation reach the first lifespan values Xa, Xb, and Xc is divided into plural levels. For example, the levels of the amounts of variation of the respective indicators A, B, and C in the initial use stage of the consumable supply 3 are set to a residual amount of "100%" since the amounts consumed are zero. The levels of the amounts of variation of the respective indicators A, B, and C when the amounts of consumption reach the first lifespan values Xa, Xb, and Xc are set to a residual amount of "0%" since the amounts of consumption reach the maximum. A range (0 to 100%) of the amount consumed (residual amount) during the period in which the residual amount changes from 100% to 0% is evenly divided into 6 regions. In this case, as shown in FIGS. 7A to 7C, the boundary values of the individual divided regions correspond to consumption levels 1 to 5 from the side of the residual amount 100% (for example, the consumption levels are denoted by "La1 to La5" for the indicator A).

At this time, when it is determined that the indicator A exceeds the consumption level La, information on the increase (La+1) of the consumption level La by one level (1 level) is written to the memory 5 (S36), and the information on the consumption level (La+1) of the indicator A at that time is notified to the input/display section 18 (the controller thereof) (S37). The information on the increase of the consumption level La is, for example, level information when the determination (detection) is made and the date when the determination is made. Moreover, the information on the increase of the consumption level La is stored in the memory 5, for example, as a consumption level history table of the indicator A as shown in FIG. 8A.

Moreover, when it is determined that the indicators B and C exceed the respective consumption levels Lb and Lc, similarly to the indicator A, information on the increase of the respective consumption levels Lb and Lc is written to the memory 5 (S38 and S40), and information on the consumption levels (Lb+1 and Lc+1) of the indicators B and C at that time is notified to the input/display section 18 (S39 and S41). When none of the consumption levels of the indicators A, B, and C exceed one level, standby is performed until the next indicator detection results are obtained.

When the information on the increase of the consumption level of any one of the indicators A, B, and C is notified to the input/display section 18, and a display request is received, the consumption level of the indicator being requested is displayed on the display device 17*a* of the operation panel 17 which is the input/display section 18 (S42 to S43). The display request may be issued by the user performing an input operation for displaying the consumption level from the input/display section 18 or may be set as default so that the consumption level is always displayed.

The display of the consumption level at that time may be shown in a format such as a level meter for each of the respective indicators A, B, and C as shown in FIGS. 7A to 7C, for example. The display of the consumption level may be shown for only an indicator of which the consumption level has progressed furthest. By showing this display, the user is able to know the consumption state of the consumable supply 3 (the photosensitive drum 21) as necessary. When the consumption has progressed relatively far, the user can recognize that the time to replace the consumable supply 3 is approaching and check if a backup consumable supply 3 is present and make preparations for the consumable supply 3.

On the other hand, when it is determined in step S32 that the extension mode is selected, as described above, since the indicator used in the lifespan management operation is limited to one indicator A, it is determined whether or not the amount of variation of the indicator A exceeds one level of the consumption level La (S45).

At this time, although the indicators B and C are detected, the determination (S34 and S35) as to whether the amounts of variation of the indicators B and C at that time exceed each step of the respective consumption levels Lb and Lc is not performed. Therefore, since the processing content in the control device 14 decreases, an operation of determining the state of the consumption level in the extension mode, and the operations of writing and displaying the information at that time are performed efficiently. In addition, although the determination as to the amounts of variation of the remaining indicators B and C may be performed, the information on the determination results is not used for the lifespan determination.

In this case, when it is determined that the indicator A exceeds the consumption level La, similarly to the processing content of the indicator A when the extension mode is not selected, the information on the increase of the consumption level La is written to the memory 5 (S46), and the information on the consumption level (La+1) at that time is notified to the input/display section 18 (S47). Since the notification at this time involves transmitting only the information on the increase of the consumption level La of the indicator A, the amount of data in the data transmission operation and the number of operations processed decrease. In addition, at that time, when the consumption level of the indicator A does not exceed one level, standby is performed until the next detection results are obtained for the indicator A.

Subsequently, when the information on the increase of the consumption level of the indicator A is notified to the input/display section 18, and only a display request is received, the consumption level La of the indicator A is displayed on the display device 17*a* of the operation panel 17 which is the input/display section 18 (S48 to S49).

The display of the consumption level at that time may be shown for only the indicator A as shown in FIG. 7A. In this way, even in the period when the extension mode is set, the user can know the progress state of consumption based on the indicator A of the consumable supply 3 (the photosensitive drum 21) in the extension mode period as necessary. Moreover, even in this case, when the consumption has progressed relatively far, the user can recognize that the time to replace the consumable supply 3 is approaching and check if a backup consumable supply 3 is present and make preparations for the consumable supply 3 as well as predict a remaining period in which a print operation can be executed in the extension mode period.

<Communication Process>

Figure 9:
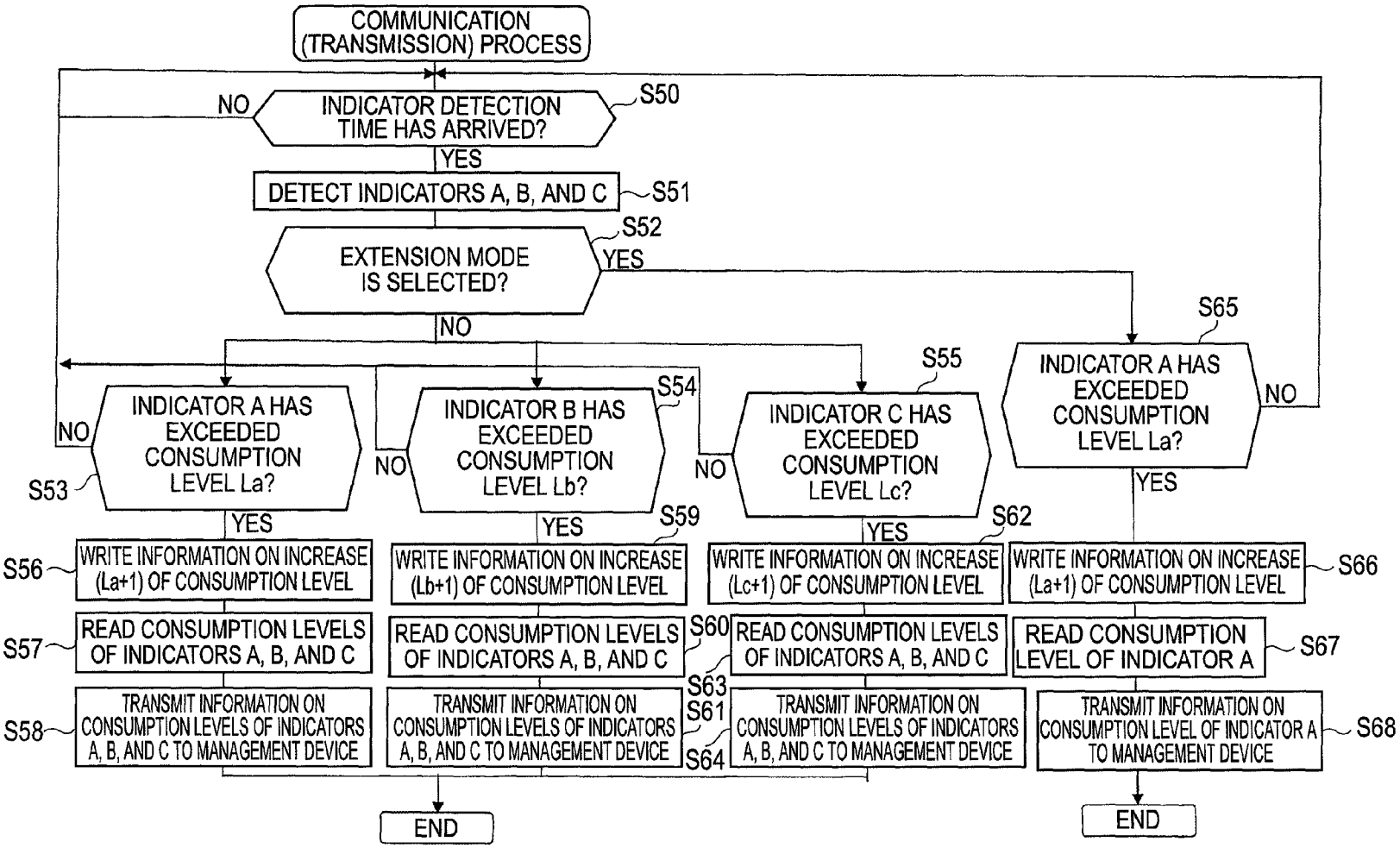
FIG. 9 is a flowchart showing a communication operation in the image forming apparatus.

In the image forming apparatus 1, the following communication operations as shown in FIG. 9 are performed in relation to the lifespan management operation of the consumable supply 3 and the notification and display operation.

That is, the control device 14 determines whether or not the indicator detection time has come (S50), detects the indicators A, B, and C (S51), and determines whether or not the extension mode is selected (S52) similarly to part (steps S10 to S12 in FIG. 4) of the lifespan management operation. At this time, when it is determined that the extension mode is not selected, it is determined whether or not the amount of variation of each of the respective indicators A, B, and C exceeds each step of the consumption levels La, Lb, and Lc (S53, S54, and S55) similarly to part (S33, S34, and S35) of the notification and display operation.

When it is determined that any one of the indicators A, B, and C exceeds one level, similarly to the other part (S36, S38, and S40) of the notification and display operation, the information on the increase of the respective consumption levels La, Lb, and Lc of the respective indicators A, B, and C is written to the memory 5 (S56, S59, and S62), and the information on the consumption levels La, Lb, and Lc is transmitted to the management device 100 (S57 and S58, S60 and S61, and S63 and S64).

Specifically, when it is determined that the indicator A exceeds the consumption level La, the information on the increase of the consumption level La is written to the memory 5 (S56), all pieces of the information on the consumption levels La, Lb, and Lc of the respective indicators A, B, and C, which have already been stored in the memory 5, are read (S57), and the read information is transmitted from the communication section 8 to the management device 100 (S58). The read and transmitted information on the consumption levels La, Lb, and Lc at that time includes the respective consumption levels, the detection dates, and the like (see FIGS. 8A to 8C). In particular, at this time, rather than transmitting only the information on the consumption level of the indicator A which exceeds one level of the consumption level, the information on the respective consumption levels of the other indicators B and C at that time is also transmitted at the same time. Moreover, the transmission of the information at that time is achieved by transmitting the information from the communication section 8 on the image forming apparatus 1 side and then receiving the information on the communication section 103 of the management device 100 through the communication unit 150. The communication sections 8 and 103 perform an encoding process or the like necessary for the transmitted and received information.

When it is determined that the indicators B and C exceed the respective consumption levels Lb and Lc, similarly to the indicator A, the information on the increase of the respective consumption levels Lb and Lc is written to the memory 5 (S59 and S62), all pieces of the information on the consumption levels La, Lb, and Lc of the respective indicators A, B, and C, which have already been stored in the memory 5, are read (S60 and S63), and the read information is transmitted from the communication section 8 to the management device 100 (S61 and S64). When none of the consumption levels of the indicators A, B, and C exceed one level, standby is performed until the next indicator detection results are obtained.

On the other hand, when it is determined in step S52 that the extension mode is selected, as described above, similarly to the case of the notification and display operation, it is determined whether or not the amount of variation of the indicator A specified in the lifespan management operation exceeds each step of the consumption level La (S65). When it is determined that the consumption level La exceeds one level, the information on the increase of the consumption level of the indicator A is written to the memory 5 (S66), and the information on the consumption level La of the indicator A is transmitted to the management device 100 (S67 and S68).

Specifically, when it is determined that the indicator A exceeds the consumption level La, the information on the increase of the consumption level La is written to the memory 5 (S66), only the information on the consumption level La of the indicator A which has already been stored in the memory 5 is read (S67), and only the read information is transmitted from the communication section 8 to the management device 100 (S68).

That is, at this time, only the information on the consumption level of the indicator A which exceeds one level of the consumption level is transmitted, and the information on the respective consumption levels of the other indicators B and C is not transmitted. Therefore, since the communication at this time involves transmitting only the information on the consumption level La of the indicator A, the amount of data in the data transmission operation and the number of operations processed decrease. As a result, since the processing content in the control device 14 and the communication section 8 decreases, an operation of determining the state of the consumption level in the extension mode, and the operations of writing and transmitting the information at that time are performed efficiently. In addition, at that time, when the consumption level of the indicator A does not exceed one level, standby is performed until the next detection results are obtained for the indicator A. In addition, although the information on the respective consumption levels of the other indicators B and C may be transmitted, the transmitted information is not used for the lifespan determination.

The information on the consumption levels La, Lb, and Lc of the respective indicators A, B, and C transmitted to the management device 100 is stored and preserved for each of the indicators A, B, and C in the memory 102. In this way, the management device 100 can also perform management on the consumable supply 3 based on the information (FIGS. 8A to 8C) on the consumption levels La, Lb, and Lc of the respective indicators A, B, and C. In particular, in the period after the extension mode is selected, since only the information on the consumption level La of the indicator A is transmitted, the management of the consumable supply 3 is performed based on only the information on the consumption level La of the indicator A. Thus, the management can be performed efficiently.

<Expiration Date Prediction and Communication Operation>

Figure 10:
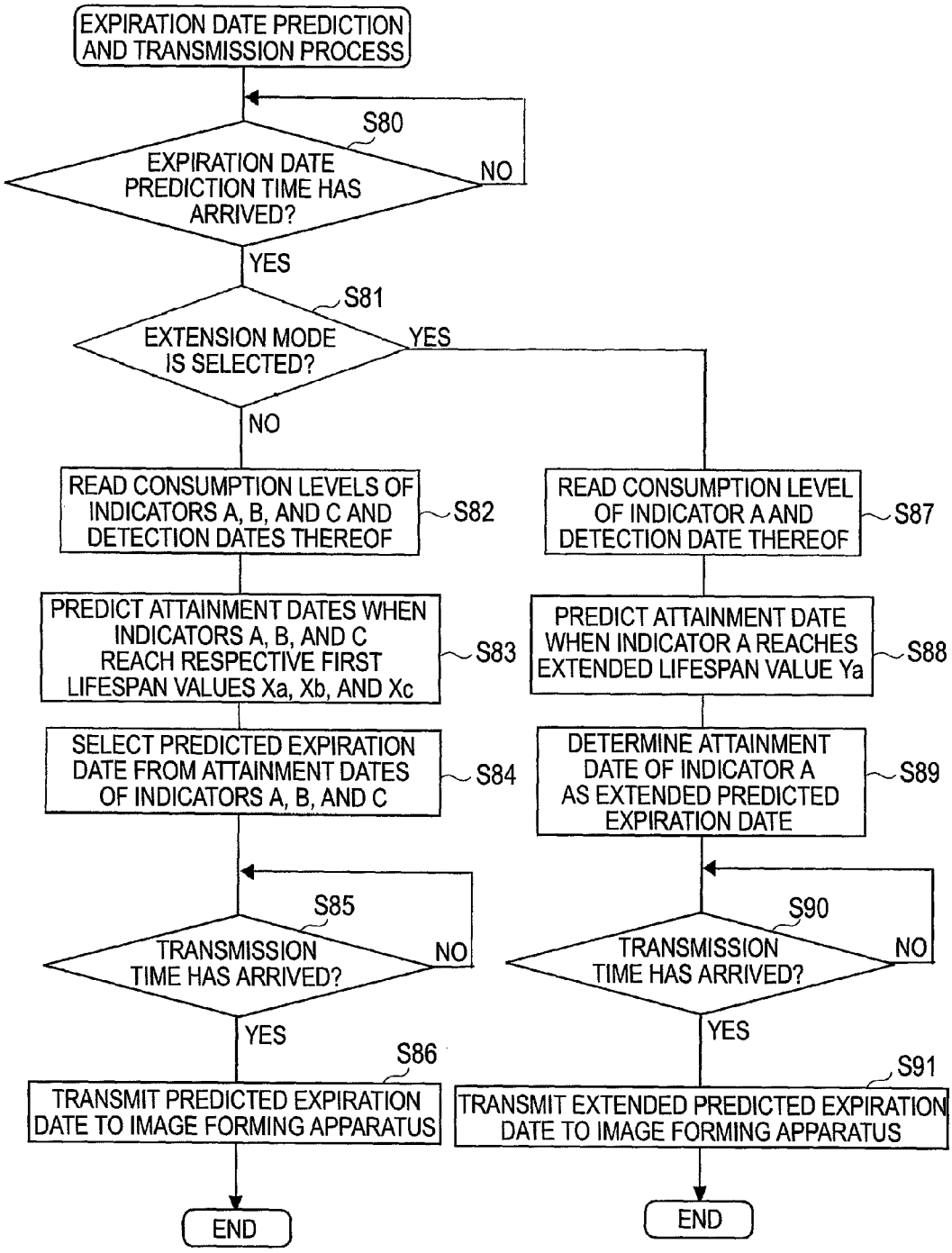
FIG. 10 is a flowchart showing an expiration date prediction and communication operation in the memory.

Next, the management device 100 performs an expiration date prediction and communication operation as shown in FIG. 10 in relation to the lifespan management operation of the consumable supply 3, the notification and display operation in the image forming apparatus 1.

That is, the controller 101 of the management device 100 detects whether the time to predict the expiration date of the photosensitive drum 21 which is the consumable supply 3 has come (S80). When the prediction time has arrived, the controller 101 determines whether or not the extension mode is selected in the image forming apparatus 1 (S81). The prediction time is set in advance, and for example, is the time at which a predetermined period has elapsed after the start of a print operation, the time at which the number of pages printed has reached a predetermined number, and a predetermined period during the print operation or the like.

When it is determined instep S81 that the extension mode is not selected, the controller 101 (the prediction section 120) reads the information (the consumption levels and the detection dates thereof: see FIGS. 8A to 8C) on the consumption levels La, Lb, and Lc of the respective indicators A, B, and C stored in the memory 102 (S82) and performs a process of predicting the date when the respective indicators A, B, and C reach the first lifespan values Xa, Xb, and Xc (S83).

Figure 11:
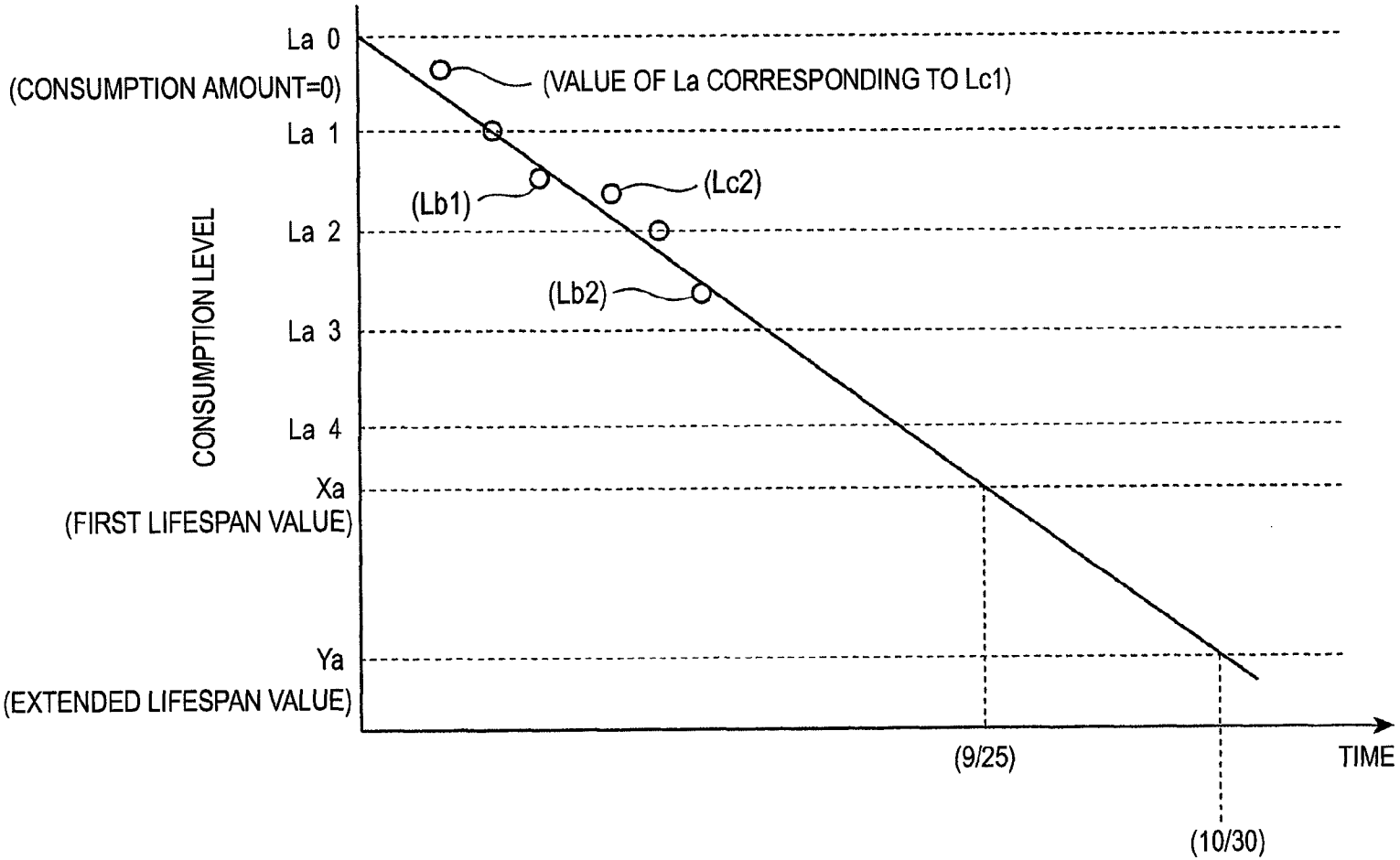
FIG. 11 is a diagram illustrating a predicted expiration date of an indicator A and a principle of predicting an extended predicted expiration date.
Figure 12A:
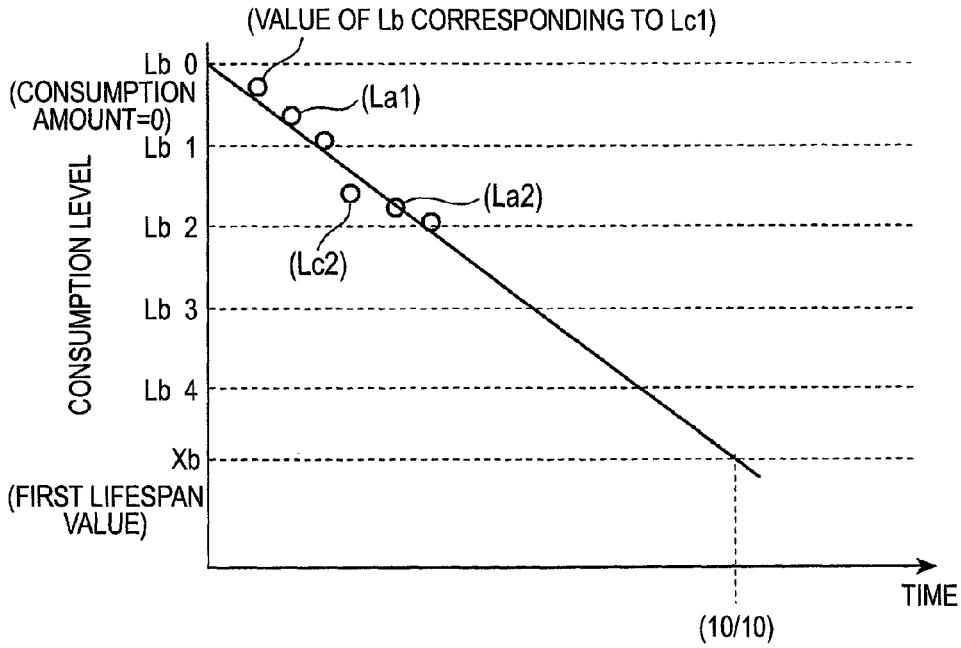
FIGS. 12A and 12B are diagrams illustrating the principle of predicting the respective predicted expiration dates of indicators B and C.
Figure 12B:
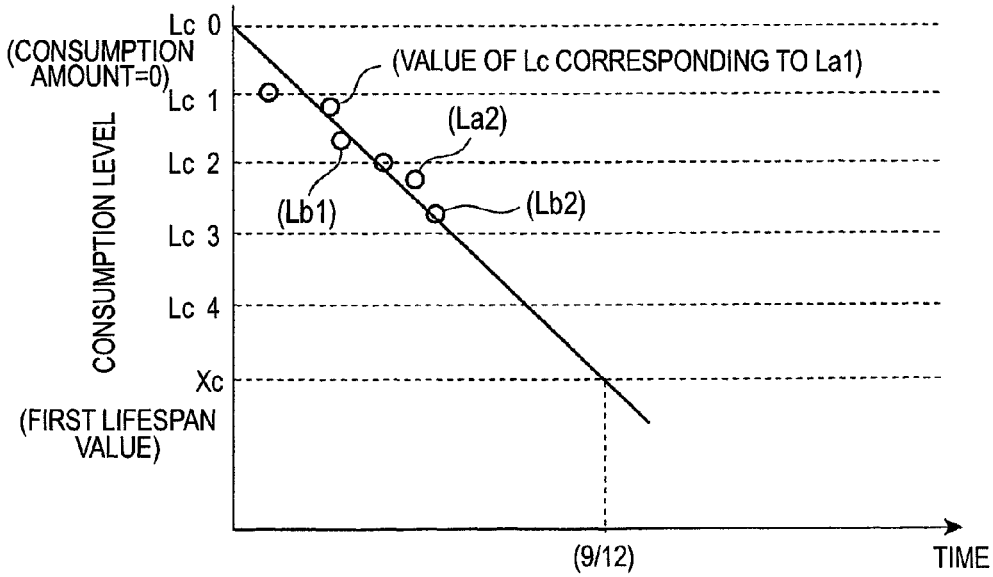

The prediction of the expiration date is performed as follows. As shown in FIG. 11 and FIGS. 12A and 12B, all pieces of the obtained information (consumption levels and the detection dates) on the consumption levels La, Lb, and Lc of the respective indicators A, B, and C are situated in a matrix for each of the indicators A, B, and C, of which a vertical axis represents the respective consumption levels L, and a horizontal axis represents the elapsed time (date information). Then, an approximate line (solid straight line) is calculated from the recorded data (circles in the drawings), and the date information when the approximate line reaches (crosses) the values of the respective first lifespan values Xa, Xb, and Xc is calculated. In this way, attainment dates of the respective indicators A, B, and C can be obtained. The attainment dates of the respective indicators shown in FIG. 11 and FIGS. 12A and 12B are September 25 (month/day) for the indicator A, October 10 for the indicator B, and September 12 for the indicator C.

Subsequently, the earliest attainment date among the attainment dates at which it is predicted that the respective indicators A, B, and C reach the first lifespan values Xa, Xb, and Xc is set as a predicted expiration date of the consumable supply 3 (S84). When the time to transmit the predicted expiration date of the consumable supply 3 arrives (S85), the predicted expiration date is transmitted from the management device 100 (the notification section 130 of the controller 101 thereof) to the image forming apparatus 1 (S86). The transmission time is set in advance, and for example, is the time at which a print operation starts, the time at which the number of pages printed has reached a predetermined number, and a predetermined period during the print operation or the like.

In this case, the image forming apparatus 1 may display the received predicted expiration date of the consumable supply 3 on the operation panel 17, which is the input/display section 7, or the like, as necessary. In this way, the user can know a remaining period in which a print operation can be executed, check if a backup consumable supply 3 is in stock and make preparations for the consumable supply 3.

Moreover, when the management device 100 has a management function of automatically delivering the consumable supply 3 to the user, an expected delivery date of the consumable supply can be set based on the information on the predicted expiration date. Moreover, works such as delivery can be efficiently managed in advance based on the information on the expected delivery date or the like.

On the other hand, when it is determined in step S81 that the extension mode is selected, the controller 101 (the prediction section 120) reads only the information (the consumption level and the detection date: see FIGS. 8A to 8C) on the consumption level La of the indicator A stored in the memory 102 (S87) and performs a process of predicting the date at which the indicator A reaches the extended lifespan value Ya (S88).

The prediction of the expiration date at that time is performed as follows. As shown in FIG. 11, all pieces of the obtained information (consumption level and the detection date) on the consumption level La of the indicator A are situated in a matrix for the indicator A, of which the vertical axis represents the consumption level L, and the horizontal axis represents the elapsed time (date information). Then, an approximate line is calculated from the recorded data, and the date information when the approximate line reaches the value of the extended lifespan value Ya of the indicator A is calculated. In this way, the attainment date when the indicator A reaches the extended lifespan value Ya can be obtained. The attainment date of the indicator A shown in FIG. 11 is October 30 (month/day). The attainment date at this time is later than the attainment date (September 25) of the first lifespan value Xa of the indicator A.

In the prediction process when the extension mode is set, since it is only necessary to perform the process based on the information on the consumption level La of the indicator A, the number of operations or the like decreases, and the prediction process can be performed in an efficient and quick manner.

Subsequently, the attainment date at which it is predicted that the indicator A reaches the extended lifespan value Ya is determined as an extended predicted expiration date of the consumable supply 3 (S89). When the time to transmit the extended predicted expiration date of the consumable supply 3 arrives (S90), the extended predicted expiration date is transmitted from the management device 100 to the image forming apparatus 1 (S91).

In this case, the image forming apparatus 1 may display the received extended predicted expiration date of the consumable supply 3 on the operation panel 17, which is the input/display section 7, or the like, as necessary. In this way, the user can know a remaining period in which a print operation can be executed in the extension mode period, check if a backup consumable supply 3 is in stock and make preparations for the consumable supply 3 in the remaining period.

Moreover, when the management device 100 has a management function of automatically delivering the consumable supply 3 to the user, the expected delivery date of the consumable supply 3 in the extension mode period can be set again based on the information on the extended predicted expiration date. Moreover, works such as delivery in the extension mode period can be efficiently managed in advance based on the information on the expected delivery date or the like.

<Other Exemplary Embodiment>

Although the first exemplary embodiment illustrates a configuration example (FIG. 4 and the like) in which the user can set the extension mode at an arbitrary time before the indicator reaches the first lifespan value, another configuration may be used. For example, as shown in FIG. 13, the extension mode may be selected and set at the time when the indicator reaches the first lifespan value.

Figure 13:
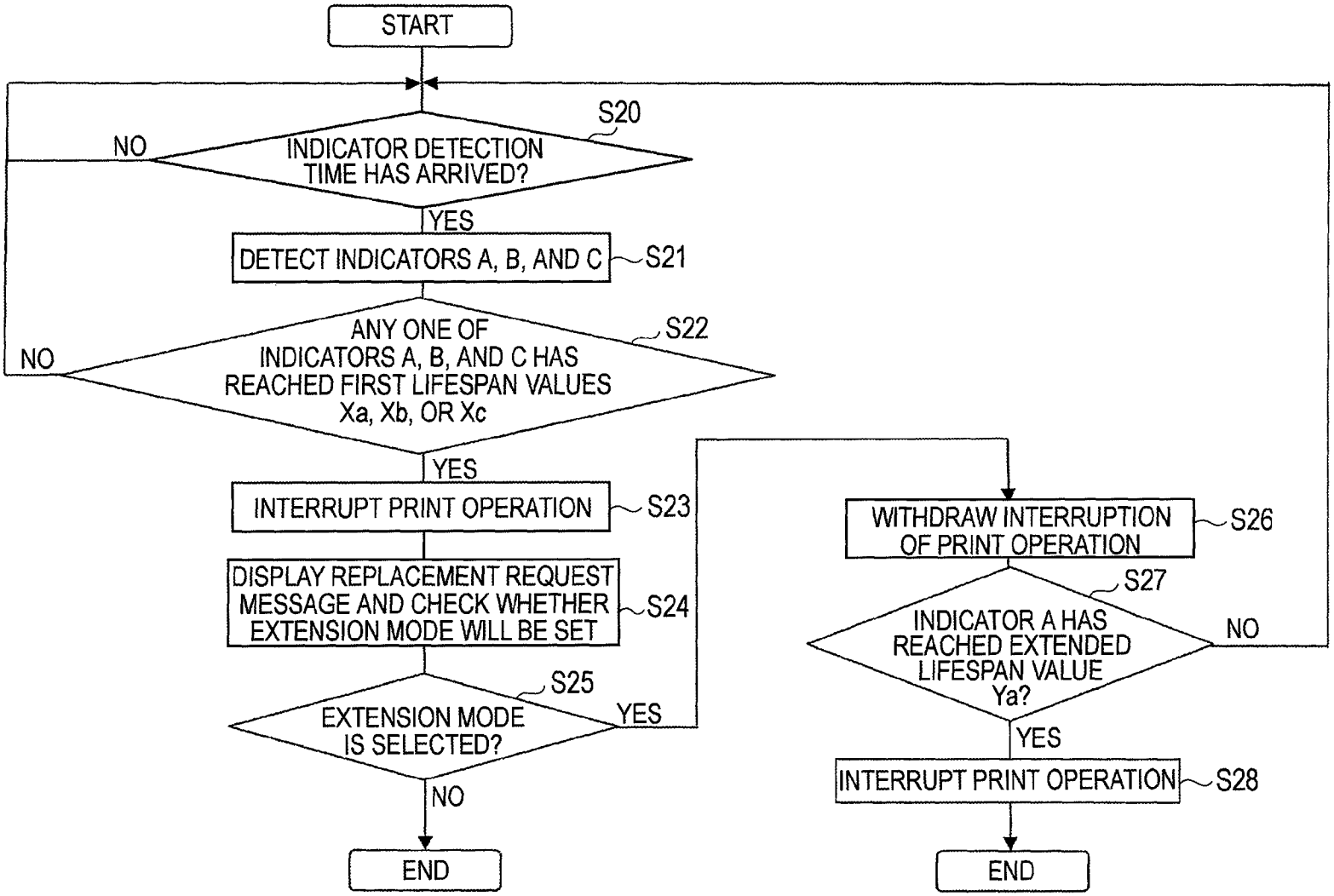
FIG. 13 is a flowchart showing another configuration example of the consumable supply management operation in the image forming apparatus.

In the configuration example shown in FIG. 13, the plural indicators A, B, and C are detected when the detection time thereof comes, and a print operation is interrupted when it is determined that only one of the indicators A, B, and C has reached the first lifespan value Xa, Xb, or Xc (S20 to S23). Thereafter, a message requesting the replacement of the consumable supply 3 is displayed on the input/display section 18 of the operation panel 17, and a selection screen (for example, an extension mode setting screen) in which the extension mode can be set is displayed (S24). Subsequently, the control device 14 (the controller 4) determines whether or not the extension mode is selected (S25). At this time, when it is determined that the extension mode is selected, the process of interrupting the print operation by the control device 14 (the interruption section 16) is inhibited (withdrawn) (S26), and it is determined whether or not the indicator A has reached the extended lifespan value Ya (S27). The print operation is interrupted when the indicator A reaches the extended lifespan value Ya in the extension mode period (S28).

Figure 6:
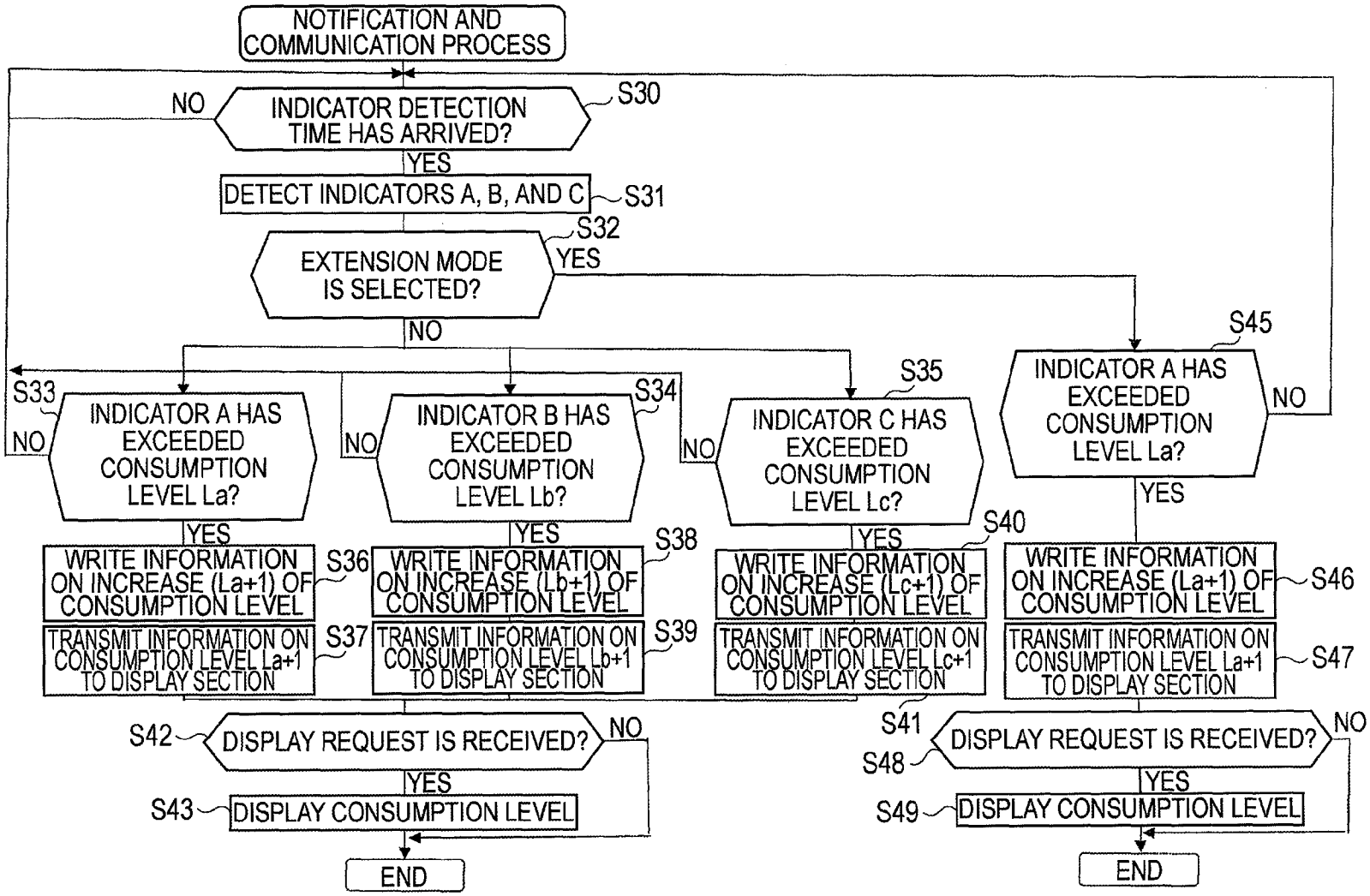
FIG. 6 is a flowchart showing a notification and display operation in the image forming apparatus.

When this configuration example is used, the respective operations after the extension mode is selected, in the notification and display operation (FIG. 6), the communication operation (FIG. 9), and the expiration date prediction and communication operation (FIG. 10) are executed after information representing that the extension mode is set is obtained in step S27.

In the exemplary embodiment 1, although the photosensitive drum 21 is illustrated as an example of the consumable supply 3, the consumable supply 3 may be other constituent components (including plural components) of the image forming section 2 as long as the amounts of consumption can be determined separately using plural indicators. The other consumable supplies 3 may be, for example, the charging device 22, the developer container 27, the collection container 28, and the like. The indicators of the other consumable supplies may be the number of pixels of an image used for printing, the amount of developer supplied, the amount of applied developer, as well as the number of pages printed and the number of rotations of the photosensitive drum 21 which are the same as the indicators B and C. As for the photosensitive drum 21, a belt-type photosensitive member may be used as an example of the consumable supply 3.

As for the extended lifespan value Y, although a case in which the extended lifespan value Ya of the indicator A which is specified when the extension mode is set is prepared has been described, extended lifespan values Yb and Yc may be set in advance for the other indicators B and C of the plural indicators, and one indicator may be arbitrarily selected out of the plural indicators when the extension mode is set.

The image forming apparatus 1 may be one which does not use the intermediate transfer device 30 and which forms a monochrome image. Moreover, the image forming apparatus to which the invention is applied is not limited to an electrophotographic apparatus that forms toner images but may use other printing methods (for example, a method of forming ink images).

When the management device 100 is provided in the image forming apparatus 1, the management device 100 performs management of the consumable supplies 3 of the image forming apparatus 1 (including the information terminal thereof) and thus can establish the consumable supply management system 200 together with the image forming apparatus 1. Moreover, when the management device 100 is provided in the image forming apparatus 1, the user can know the respective predicted expiration dates of the consumable supplies 3 and obtain triggers for checking the backup consumable supplies 3 or making preparations thereof. The image forming apparatus 1 is not limited to the case in which it is integrated with the management device 100 to form the consumable supply management system 200 but may not be integrated with the management device 100 but form only a single image forming apparatus (does not form the consumable supply management system 200).

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explaining the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A consumable supply management system comprising:

the image forming apparatus comprising:

an image forming section that includes a consumable supply and that executes an image forming operation;

a plurality of detectors that respectively detect amounts of variation of each of a plurality of indicators corresponding to the plurality of detectors, the plurality of indicators used to determine an amount consumed of the consumable supply;

a determination section that determines whether or not the detected amounts have respectively reached a plurality of first lifespan values, the plurality of first lifespan values set for the plurality of the indicators;

an interruption section that performs a process of interrupting the image forming operation of the image forming section when the determination section determines that one of the detected amounts of variation has reached a corresponding one of the plurality of first lifespan values; and an extension setting section that inhibits the process of interrupting performed by the interruption section based on the one of the plurality of first lifespan values and sets an extension mode of extending a period in which the image forming operation can be executed, wherein the determination section determines, when the extension mode is set by the extension setting section, whether or not an amount of variation of an indicator specified out of the plurality of indicators has reached an extended lifespan value different from a first lifespan value, from among the plurality of first lifespan values, set for the specified indicator, wherein the specified indicator includes only one or less than all of the plurality of indicators and indicators other than the specified indicator are not used, and wherein the interruption section interrupts the image forming operation when the extension mode is set by the extension setting section and the determination section determines that the amount of variation of the specified indicator has reached the extended lifespan value; and a management device that is communicably connected to the image forming apparatus so as to manage the consumable supply of the image forming section, wherein, when the extension mode is set by the extension setting section of the image forming apparatus, the image forming apparatus transmits information indicating the amount of variation of the specified indicator to the management device as determination information of the determination section, and the management device performs management of the consumable supply based on the determination information transmitted by image forming apparatus, wherein the determination section of the image forming apparatus further determines, based on the detected amounts of variation of each of the plurality of indicators, that the detected amounts of variation of the respective plurality of indicators have reached one of a plurality of attainment levels, the plurality of attainment levels set from an initial use stage of the consumable supply to a stage when the amounts of variation respectively reach the plurality of first lifespan values, wherein the image forming apparatus transmits, to the management device, date and time information when it is determined that the detected amounts of variation have reached one of the plurality of attainment levels, wherein the management device includes:

a memory that stores the date and time information received from the image forming apparatus;

a prediction section that predicts a plurality of attainment dates when the plurality of indicators are expected to respectively reach the plurality of first lifespan values based on the stored date and time information; and a notification section that notifies an earliest date, from among the predicted plurality of attainment dates, to the image forming apparatus as a predicted expiration date of the consumable supply, and wherein, when the extension mode is set by the extension setting section of the image forming apparatus, the prediction section predicts an attainment date when the specified indicator is expected to reach the extended lifespan value, and the notification section notifies the attainment date to the image forming apparatus as an extended predicted expiration date of the consumable supply.

2. An image forming apparatus comprising:

an image forming section that includes a consumable supply and that executes an image forming operation;

a plurality of detectors that respectively detect amounts of variation of each of a plurality of indicators corresponding to the plurality of detectors, the plurality of indicators used to determine an amount consumed of the consumable supply;

a determination section that determines whether or not the detected amounts have respectively reached a plurality of first lifespan values, the plurality of first lifespan values set for the plurality of the indicators;

an interruption section that performs a process of interrupting the image forming operation of the image forming section when the determination section determines that one of the detected amounts of variation has reached a corresponding one of the plurality of first lifespan values;

an extension setting section that inhibits the process of interrupting performed by the interruption section based on the one of the plurality of first lifespan values and sets an extension mode of extending a period in which the image forming operation can be executed, wherein the determination section determines, when the extension mode is set by the extension setting section, whether or not an amount of variation of an indicator specified out of the plurality of indicators has reached an extended lifespan value different from a first lifespan value, from among the plurality of first lifespan values, set for the specified indicator, wherein the specified indicator includes only one or less than all of the plurality of indicators and indicators other than the specified indicator are not used, and wherein the interruption section interrupts the image forming operation when the extension mode is set by the extension setting section and the determination section determines that the amount of variation of the specified indicator has reached the extended lifespan value; and a management device that manages the consumable supply of the image forming section, wherein, when the extension mode is set by the extension setting section of the image forming apparatus, the image forming apparatus transmits information indicating the amount of variation of the specified indicator to the management device as determination information of the determination section, and the management device performs management of the consumable supply based on the determination information transmitted by image forming apparatus, wherein the determination section of the image forming apparatus further determines, based on the detected amounts of variation of each of the plurality of indicators, that the detected amounts of variation of the respective plurality of indicators have reached one of a plurality of attainment levels, the plurality of attainment levels set from an initial use stage of the consumable supply to a stage when the amounts of variation respectively reach the plurality of first lifespan values, wherein the image forming apparatus transmits, to the management device, date and time information when it is determined that the detected amounts of variation have reached one of the plurality of attainment levels, wherein the management device comprises:

a memory that stores the date and time information received from the image forming apparatus;

a prediction section that predicts a plurality of attainment dates when the plurality of indicators are expected to respectively reach the plurality of first lifespan values based on the stored date and time information; and a notification section that notifies an earliest date, from among the predicted plurality of attainment dates, to the image forming apparatus as a predicted expiration date of the consumable supply, and wherein, when the extension mode is set by the extension setting section of the image forming apparatus, the prediction section predicts an attainment date when the specified indicator is expected to reach the extended lifespan value, and the notification section notifies the attainment date to the image forming apparatus as an extended predicted expiration date of the consumable supply.

3. A management device for managing a consumable supply, the management device comprising:

a memory that stores date and time information at which amounts of variation have reached one of a plurality of attainment levels, the plurality of attainment levels set from an initial use stage of the consumable supply to a stage when the amounts of variation respectively reach a plurality of first lifespan values set for a plurality of the indicators used to determine an amount consumed of the consumable supply, the date and time information received from an external device;

a prediction section that predicts a plurality of attainment dates when the plurality of indicators are expected to respectively reach the plurality of first lifespan values based on the stored date and time information; and a notification section that notifies an earliest date, from among the predicted plurality of attainment dates, to the external device as a predicted expiration date of the consumable supply, wherein, when an extension mode of extending a period in which an image forming operation can be executed by the external device by inhibiting a process of interrupting the image forming operation when one of the amounts of variation has reached a corresponding one of the plurality of first lifespan values is set by the external device, the management device receives information indicating the amount of variation of a specified indicator that has reached an extended lifespan value different from the first lifespan value as determination information of the determination section, the management device performs management of the consumable supply based on the determination information received from the external device, and wherein, when the extension mode is set by the external device, the prediction section predicts an attainment date when the specified indicator is expected to reach the extended lifespan value, and the notification section notifies the attainment date to the external device as an extended predicted expiration date of the consumable supply.

* * * * *